US009165495B2

(12) United States Patent
Tsuei et al.

(10) Patent No.: US 9,165,495 B2
(45) Date of Patent: Oct. 20, 2015

(54) CROSSTALK COMPENSATION METHOD AND DISPLAY APPARATUS USING THE SAME

(71) Applicant: INNOLUX CORPORATION, Miao-Li County (TW)

(72) Inventors: Bo-Chin Tsuei, Kaohsiung (TW); Yao-Lien Hsieh, Tainan (TW); Chih-Ting Chen, Tainan (TW)

(73) Assignee: INNOLUX CORPORATION, Miao-Li County (TW)

( * ) Notice: Subject to any disclaimer, the term of this patent is extended or adjusted under 35 U.S.C. 154(b) by 15 days.

(21) Appl. No.: 14/094,830

(22) Filed: Dec. 3, 2013

(65) Prior Publication Data

US 2014/0160174 A1 Jun. 12, 2014

(30) Foreign Application Priority Data

Dec. 7, 2012 (TW) ..... 101146128 A

(51) Int. Cl.
*G09G 5/10* (2006.01)
*G09G 3/20* (2006.01)
*G09G 3/36* (2006.01)

(52) U.S. Cl.
CPC ..... *G09G 3/2003* (2013.01); *G09G 3/3607* (2013.01)

(58) Field of Classification Search
None
See application file for complete search history.

(56) References Cited

U.S. PATENT DOCUMENTS 7,522,127 B2 4/2009 Nakamoto et al.
2005/0168424 A1* 8/2005 Nakamoto et al. ..... 345/89

* cited by examiner

*Primary Examiner* — Joseph Haley
*Assistant Examiner* — Ifedayo Iluyomade
(74) *Attorney, Agent, or Firm* — Li & Cai Intellectual Property (USA) Office

(57) ABSTRACT

The present disclosure provides a crosstalk compensation method and a display apparatus using the same. The method includes: configuring a compensation range with the compensation range set between the maximum gray level and the minimum gray level; establishing a look-up table to record compensation values for each gray level in the compensation range; determining whether the gray level of a first color sub-pixel on the display panel is set within the compensating range. When it is determined that the gray level of the first color sub-pixel is set within the compensation range selects a compensating value for configuring an initial gray level of an adjacent second color sub-pixel to a correction gray level. When it is determined that the gray level of the first color sub-pixel is set outside the compensation range, maintains the gray level of the second color sub-pixel at the initial gray level.

8 Claims, 5 Drawing Sheets

CROSSTALK COMPENSATION METHOD AND DISPLAY APPARATUS USING THE SAME

BACKGROUND

1. Technical Field

The present disclosure relates to a compensation method of a display panel and a display apparatus thereof, in particular, to a crosstalk compensation method of a display panel and a display apparatus using the same.

2. Description of Related Art

As display panels have advantages such as light weight, compact, low power consumption, and small battery, display panels have been widely used in all kinds of communication and consumer electronic products e.g., television, laptop, mobile phone and personal digital assistant (PDA).

Exiting methods such as reducing spacing between the adjacent pixels or overlapping electrode of one sub-pixel with the data line of the adjacent sub-pixel has been commonly adopted to increase the aperture ratio associated with pixels on the display panel to enhance the characteristics of higher transmittance or low power consumption. However, the exiting methods described in practice would increase the capacitance coupling and generating crosstalk effecting display quality. Currently, a polymer film on array with thickness of 2~4 um on the electrode of sub-pixel may reduce the coupling effect.

However, even with the disposition of polymer film on array, certain level of capacitance coupling still exists under specific operating mode. In particular, when driving the display panel with N line inversion to display a monochromatic image, large potential difference would arises between the neighboring sub-pixels and causes severe color crosstalk. Color crosstalk herein describes the phenomenon when the computed brightness and the chroma of blended red, green, and blue color sub-pixels at a specific gray level (e.g., monochromatic red, monochromatic green, and monochromatic blue) does not equal to the brightness and the chroma of white. In which, white represents the brightness and the chroma measured when all of the color sub-pixels are at the specific gray level. Moreover, the crosstalk can be computed using equation (1) shown below, $$\text{Color crosstalk}=[(\text{brightness of white}-\text{brightness of monochromatic red}-\text{brightness of monochromatic green}-\text{brightness of monochromatic blue}-2*\text{brightness of black})/\text{brightness of white}]*100 \quad (1)$$

wherein, the brightness of black represents when the brightness when all the color sub-pixels are at zero gray level i.e., the brightness of the background.

If the maximum crosstalk of the display panel exceeds a customer specification (e.g., the maximum color crosstalk is mostly set to be 20%) indicating that the display quality (e.g., the gray level brightness discrepancy become prominent) of the display panel under the customer specification may be relatively poor compare to the other display panels and would not be acceptable by the customer.

SUMMARY

Accordingly, exemplary embodiments of the present disclosure provides a compensation method of a display panel and the display apparatus thereof, which can synchronously adjust the gray level voltage of one sub-pixel according to the gray level of an adjacent sub-pixel so as to reduce or eliminate the crosstalk generated therebetween, thereby enhance the quality of the display panel.

An exemplary embodiment of the present disclosure provides a compensation method for a display panel. The method includes the following steps. A compensation range lying between the maximum gray level and the minimum gray level is configured. A look-up table recording compensation value for each gray level in the compensation range is next established. When determines that the gray level of the first color sub-pixel is set within the compensation range, select a compensating value for a second color sub-pixel from the look-up table. Subsequently, an initial gray level of the second color sub-pixel is configured to a correction gray level. When determines that the gray level of the first color sub-pixel is set outside the compensation range, maintains the gray level of the second color sub-pixel at the initial gray level. The first color sub-pixel is in adjacent to the second color sub-pixel.

An exemplary embodiment of the present disclosure provides a display apparatus and the display apparatus includes a display panel, and a driver unit. The display panel has a first color sub-pixel and an adjacent second color sub-pixel. The driver unit includes a timing controller, a data driver unit, and a storage module. The data driver circuit receives gray level signals outputted by the timing controller, and converts the gray level signals into driving voltages so as to drive the first color sub-pixel and the second color sub-pixel of the display panel. The driver unit is configured to execute the following steps. The driver unit configures a compensation range wherein the compensation range lies between the maximum gray level and the minimum gray level. The driver unit establishes a look-up table for recording a compensation value for each gray level in the compensation range in the storage module. When the timing controller of the driver unit determines that the gray level of the first color sub-pixel is set within the compensation range, the timing controller selects a compensating value from the look-up table for configuring an initial gray level of the second color sub-pixel to a correction gray level. When the timing controller determines that the gray level of the first color sub-pixel is set outside the compensation range, the timing controller maintains the gray level of the second color sub-pixel at the initial gray level.

In summary, exemplary embodiments of the present disclosure provides a crosstalk compensation method for a display panel and the display apparatus using the same, which can effective reduce or eliminate the crosstalk between a color sub-pixel and an adjacent color sub-pixel on the display panel by configuring the brightness of the adjacent color sub-pixel while driving the color sub-pixel to display a gray level. Accordingly, the potential difference between the electrodes of the neighboring sub-pixels and the brightness discrepancy may be reduced thereby enhanced the overall display quality.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

FIG. 4-1 and FIG. 4-2 respectively are flowchart diagrams illustrating a crosstalk compensation method of a display panel provided in accordance to an exemplary embodiment of the present disclosure.

DESCRIPTION OF THE EXEMPLARY EMBODIMENTS

Figure 1:
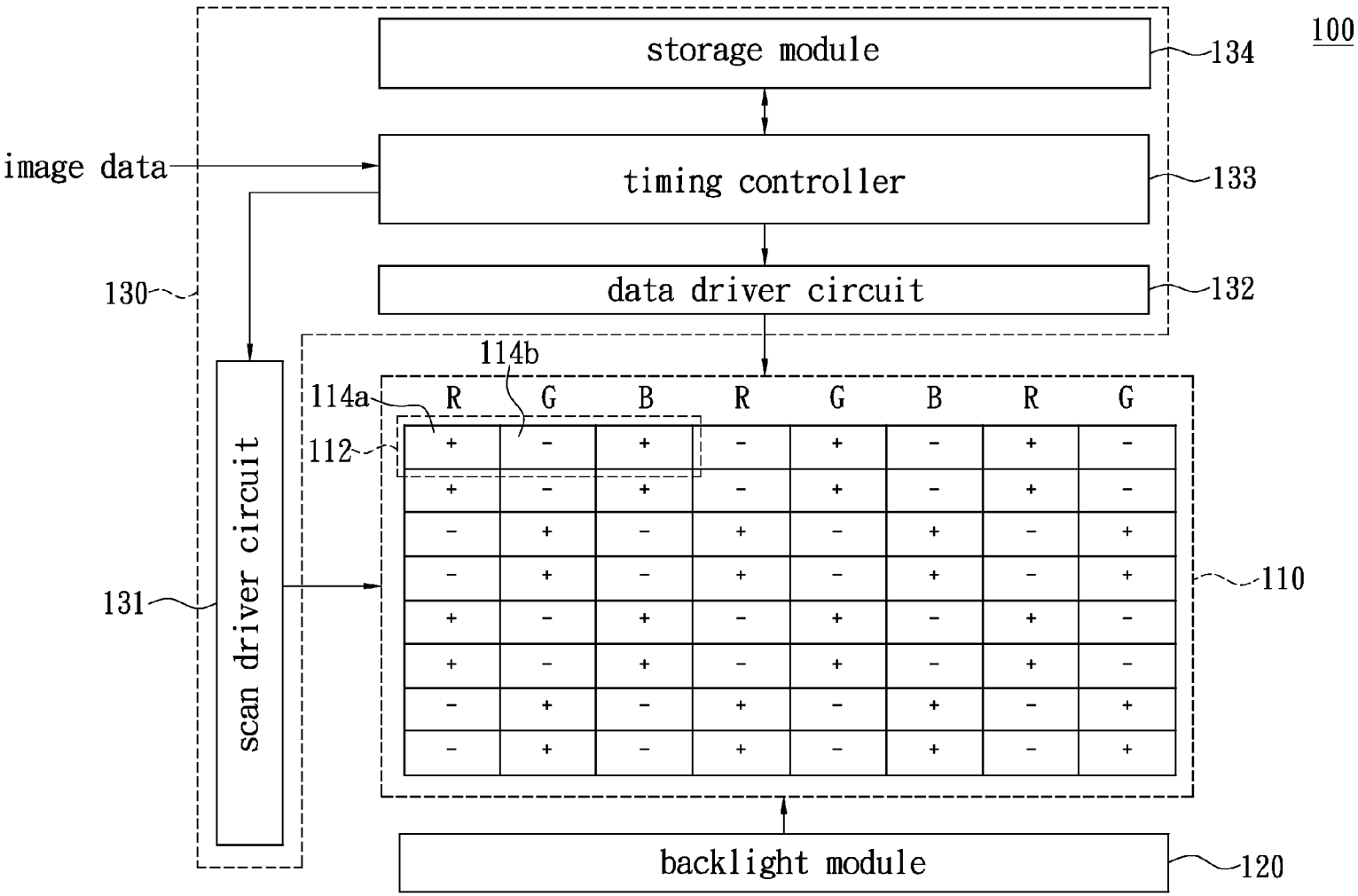
FIG. 1 is a schematic diagram of a display panel provided in accordance to an exemplary embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

Please refer to FIG. 1, which shows a schematic diagram of a display panel provided in accordance to an exemplary embodiment of the present disclosure. The display apparatus 100 is a liquid crystal display (LCD) apparatus which includes a display panel 110, a backlight module 120, and a driver unit 130. The driver unit 130 is coupled to the display panel 110 and the backlight module 120, respectively. The driver unit 130 is used for providing a data signal and a scan signal to drive the display panel 110 and the backlight module 120. In the instant embodiment, the driver unit 130 can utilize a gray level compensation technique (i.e., crosstalk compensation method) to reduce or eliminate the crosstalk generated as result of coupling between the electrode of sub-pixel being driven (e.g., red color sub-pixel R) and the electrode of the adjacent sub-pixel (e.g., green color sub-pixel G) or data line (not shown) on the display panel 110. Such that the display quality of the display panel 110 may be enhanced.

The display panel 110 has a pixel array which includes a plurality of pixels 112, M parallel but isolated scan lines (not shown), and N data lines (not shown) interlaced with the scan lines, wherein M, N are positive integers. Each pixel 112 on the display panel 110 comprises of three color sub-pixels, i.e., a red color sub-pixel R, a green color sub-pixel G, and a blue color sub-pixel B. The three color sub-pixels of a single pixel are all coupled to a scan line while each of the color sub-pixels respectively coupled to a respective data line. Each column of the pixel array is of an identical color sub-pixel (e.g., Red color filter stripe, Green color filter stripe, Blue color filter stripe), and each row is arranged with the sequence of the red color sub-pixel R, the green color sub-pixel G, and the blue color sub-pixel B.

The display panel 110 adopts a driving technique of the N-line inversion. In particular, as the polarity in FIG. 1 shows that the display panel 110 uses 2-line inversion driving technique. That is, the polarity of gray level voltage for the sub-pixels alternates for every two scan line pairs (e.g., for every two horizontally rows). It is worth to note that the display panel 110 may also uses driving technique such as three-line inversion, dot inversion, or column inversion and the instant present disclosure is not limited thereto.

The display panel 110 may utilize the color sub-pixels (i.e., the red color sub-pixel R, the green color sub-pixel G, and the blue color sub-pixel B) to display a display image responsive to an image data. The backlight module 120 is configured to provide the necessary lighting for the display panel 110. If the display panel 110 operates in self-lighting mode then the backlight module 120 may be removed.

The driver unit 130 is used for outputting scan signals, processing the digital representation of the image data corresponding to the display image, and converting into analog type of gamma driving voltage to drive each color sub-pixel (i.e., the red color sub-pixel R, the green color sub-pixel G, and the blue color sub-pixel B) in the pixel array of the display panel 110. So that the display component (e.g., liquid crystal, light-emitting diode) on the display panel 110 can be configured to display the display image corresponding to the image data to the viewers.

The driver unit 130 further includes a scan driver circuit 131, a data driver circuit 132, a timing controller 133, and a storage module 134. The scan driver circuit 131 and the data driver circuit 132 are respectively coupled to the scan lines and the data lines disposed on the display panel 110. The scan driver circuit 131 and the data driver circuit 132 are coupled to the timing controller 133. The timing controller 133 is further coupled to the storage module 134.

The scan driver circuit 131 is controlled by the timing controller 133 to sequentially output a scan signal driving M scan lines of the pixel array of the display panel 110. Each row of scan lines is coupled to a plurality of pixels 112, wherein each pixel comprises the red color sub-pixel R, the green color sub-pixel G, and the blue color sub-pixel B. The described technical features of pixel structure and operations are known to those skilled in the art, hence further descriptions are omitted.

The data driver circuit 132 is also controlled by the timing controller 133. The data driver circuit 132 receives the digital gray level signals from the timing controller 133 and converts the digital gray level signals into corresponding driving voltages. The data driver circuit 132 operates with the scan driver circuit 131 and outputs the driving voltages to the data lines as the scan lines being enabled by the scan driver circuit 131.

The timing controller 133 analyzes the image data constituting the display image and acquires the polarity of driving data for all the sub-pixels on the display panel 110 for controlling the gray level variation of each color sub-pixel (i.e., first color sub-pixel, e.g., red color sub-pixel 114*a*) and the adjacent color sub-pixel (i.e., second color sub-pixel, e.g., green color sub-pixel 114*a*).

In the instant embodiment, the timing controller 133 correspondingly adjusts an initial gray level of the adjacent second color sub-pixel (e.g., green color sub-pixel 114*b*) according to the first color sub-pixel (e.g., red color sub-pixel 114*a*) of the image data. Such that the crosstalk generated between the first color sub-pixel (e.g., red color sub-pixel 114*a*) and the second color sub-pixel (e.g., green color sub-pixel 114*b*) can be effectively eliminated. It is worth to note that the color of the first color sub-pixel and the second color sub-pixel is not limited herein. That is the first color sub-pixel and the second color sub-pixel could be any color combination other than red-green combination, for example the green color sub-pixel G and the blue color sub-pixel B.

To put it concretely, the timing controller 133 may active search the storage module 134 to acquire compensation values corresponding to each gray level of the second color sub-pixel and configure the initial gray level to a correction gray level of the second color sub-pixel. The timing controller 133 outputs a correction gray level signal for the second color sub-pixel to the data driver circuit 132. The data driver circuit 132 outputs the gray level voltage adjusting the brightness of the second color sub-pixel. Such that the discrepancy between the brightness (or driving voltage) of the first color sub-pixel and the second color sub-pixel shown on the display image may be eliminated.

Specifically, the storage module 134 has a look-up table stored therein, and the look-up table records the compensation values corresponding to each gray level of each color sub-pixel. The establishing method for the look-up table includes determining a compensation range and inputting the compensation gray level for each gray level of the second color sub-pixel, subsequently. Particularly, the compensation range is greater than a minimum gray level of the first color sub-pixel and less than a maximum gray level of the first color sub-pixel. In other words, the compensation range lies between the maximum gray level of the first color sub-pixel and the minimum gray level thereof. The compensation range excludes the maximum gray level and the minimum gray level of the first color sub-pixel to avoid having the display panel 110 unable to meet the brightness and the chroma of each monochromatic color (i.e., the maximum gray level and the minimum gray level of a single color sub-pixel) provided in the customer's specification. Take a single color sub-pixel of the display panel 110 having 8-bit resolution as an example i.e., each color sub-pixel has 256 gray levels. Accordingly, the compensation range of the first color sub-pixel does not include the gray level of 0 and the gray level of 255.

Additionally, the compensation range may be configured according to the gray level range of the color sub-pixel that has been affected by crosstalk, but the present disclosure is not limited thereto. In practice, the compensation range may be configured according to the color crosstalk of the display panel 110 measured. Moreover, the look-up table records non-zero compensation values within the compensation range and records the compensation values as gray level of zero outside the compensation range.

When the timing controller 133 determines that the gray level of the first color sub-pixel is set within the compensation range according to the image data, the timing controller 133 compensates the initial gray level of the adjacent second color sub-pixel to generate the correction gray level. The timing controller 133 outputs the correction gray level signal corresponding to the second color sub-pixel to the data driver circuit 132 subsequently. When the timing controller 133 determines that the gray level of the first color sub-pixel is set outside the compensation range according to the image data, the timing controller 133 does not compensate the gray level of the second color sub-pixel. The timing controller 133 preserves the initial gray level by outputting an initial gray level signal corresponding to the second color sub-pixel to the data driver circuit 132.

Additionally, a single color sub-pixel in the instant embodiment has i gray level. For an 8-bit color sub-pixel has 256 gray levels, i equals to 256 and for a 10-bit color sub-pixel has 1024 gray levels, i equals 1024, wherein i is positive integer. The compensation values of the second color sub-pixel for each gray level within the compensation range forms an ascending compensation sequence according to the gray level of the first color sub-pixel. If the compensation values of the second color sub-pixel within the compensation range of the first color sub-pixel range from gray level of 0 to gray level of 2, then a maximum value of the compensation sequence is less than or equal to i/128. If the compensation values of the second color sub-pixel within the compensation range of the first color sub-pixel range from gray level of 0 to gray level of 4, then a maximum value of the compensation sequence is less than or equal to i/64. Such that the occurrence of brightness discrepancy affecting the display quality may be avoid. In other words, the maximum value of the compensation sequence for the second color sub-pixel within the compensation range may be configured according to an optical specification assigned for the second color sub-pixel on the display panel 110.

Moreover, the compensation values of the compensation sequence increase from a lower limit of the compensation range to the maximum value of the compensation sequence. That is the compensation values in the compensation sequence closer to the maximum value are substantially greater than or equal to the compensation value closer to the lower limit of the compensation range. On the other hand, the compensation values decrease from the maximum value of the compensation sequence to an upper limit of the compensation range. That is the compensation values of the compensation sequence closer to the maximum value are substantially greater than or equal to the compensation value closer to the upper limit of the compensation range. Alternatively, the compensation values of the compensation sequence increase as the gray level of the first color sub-pixel increases between the lower limit of the compensation range and the maximum value of the compensation sequence. In other words, the compensation values are proportional to the gray levels of the first color sub-pixel between the lower limit of the compensation range and the maximum value of the compensation sequence. The compensation values of the compensation sequence decrease as the gray level of the first color sub-pixel increases between the maximum value of the compensation sequence and the upper limit of the compensation range. In other words, the compensation values are inversely proportional to the gray levels of the first color sub-pixel between the maximum value of the compensation sequence and the upper limit of the compensation range. Accordingly, the compensation sequence described herein exhibits a trapezoidal profile.

Incidentally, the compensation range may have a plurality of compensation series with trapezoidal profile. That is to say, the first color sub-pixel of the display panel 110 may have multiple sub-compensation ranges according to the color crosstalk measured. Such that the crosstalk between the first color sub-pixel and the second color sub-pixel within the compensation range may be reduced or eliminated through configuring the gray level of the adjacent second color sub-pixel thereby enhancing the display quality of the display panel 110.

The method of using the compensation value to correct the initial gray level of the second color sub-pixel further includes the following steps. The designer of the display panel 110 may preconfigure a maximum correction gray level of the second color sub-pixel. The maximum correction gray level of the second color sub-pixel is configured to be between a maximum gray level of the second color sub-pixel and a minimum gray level of the second color sub-pixel while excludes the maximum gray level and the minimum gray level associated with the second color sub-pixel. In particular, the maximum correction gray level is greater than or equal to the maximum compensation value of the second color sub-pixel, i.e., the maximum value of the compensation sequence.

The timing controller 133 further determines the relation between the initial gray level and the maximum correction gray level. When the timing controller 133 determines that the initial gray level of the second color sub-pixel is greater than the maximum correction gray level, the timing controller 133 directly outputs the initial gray level as the correction gray level without apply any compensation. When the timing controller 133 determines that the initial gray level of the second color sub-pixel is less than or equal to the maximum correction gray level, the timing controller 133 utilizes an interpolation equation, i.e., equation (2) and computes the correction gray level for the second color sub-pixel, $$\text{the correction gray level} = \text{the initial gray level} + \text{the compensation value} \times \left(1 - \frac{\text{the initial gray level}}{\text{the maximum correction gray level}}\right). \quad (2)$$

The correction gray level in practice is a positive integer. In one embodiment, when the correction gray level computed contain decimal, the correction gray level may be rounded off to remove the decimal. In another embodiment, the correction gray level can contain decimal, the timing controller 133 may utilize a dithering algorithm spatially or temporally flashing the second color sub-pixel so as to blend the second color sub-pixel to generate the corresponding brightness of the correction gray level. The operation and implementation of dithering algorithm is well known by those skilled in the art, and further descriptions are hereby omitted.

The gray level value corrected of the second color sub-pixel within the gray level sequence of the second color sub-pixel must be an ascending sequence. That is inversion phenomenon should not occur in the gray level sequence of the second color sub-pixel. All the correction gray level computed should be less than or equal to the maximum correction gray level of the second color sub-pixel.

Taking any color sub-pixel having 8-bit resolution as an example, the driver unit 130 can send 8-bit digital gray level signal to drive the data driver circuit 132 adjusting the driving voltage of the color-sub-pixel during the enable period of the scan driver circuit 131. The storage module 134 as aforementioned has a look-up table corresponding to the red color sub-pixel R, the green color sub-pixel G, and the blue color sub-pixel B stored therein. The look-up table records a plurality of compensation values corresponding to each gray level of each color sub-pixel within the compensation range. The timing controller 133 may thus select a compensation value from the look-up table for correcting the second color sub-pixel based on the gray level of the first color sub-pixel. An exemplary look-up table (i.e., table 1) is provided as follow.

TABLE 1

| gray level | compensation value of the red color sub-pixel (R) | compensation value of the green color sub-pixel (G) | compensation value of the blue color sub-pixel (B) |
|---|---|---|---|
| 0 | 0 | 0 | 0 |
| 1 | 0 | 0 | 0 |
| 2 | 0 | 0 | 0 |
| 3 | 0 | 0 | 0 |
| 4 | 2 | 2 | 2 |
| 5 | 4 | 4 | 4 |
| 6 | 6 | 6 | 6 |
| 7 | 8 | 8 | 8 |
| 8 | 8 | 8 | 8 |
| . | 8 | 8 | 8 |
| . | 8 | 8 | 8 |
| . | 8 | 8 | 8 |
| 250 | 8 | 8 | 8 |
| 251 | 8 | 8 | 8 |
| 252 | 6 | 6 | 6 |
| 253 | 4 | 4 | 4 |
| 254 | 2 | 2 | 2 |
| 255 | 0 | 0 | 0 |

As depicted by table 1, the compensation range of the instant embodiment ranges from gray level of 4 to gray level of 254. Or equivalently, the lower limit of the compensation range is gray level of 4 while the upper limit of the compensation range is gray level of 254.

Briefly, taking the red color sub-pixel 114*a* as the first color sub-pixel and the green color sub-pixel 114*b* as the second color sub-pixel for an example. When the timing controller 133 operatively driving the data driver unit 132 of the display panel 110 to control the red color sub-pixel 114*a* (i.e., the first color sub-pixel) to display a gray level (e.g., gray level of 6), the timing controller 133 automatically searches the look-up table stored in the storage module 134 to select the corresponding compensation value (e.g., gray level of 6) for the green color sub-pixel 114*b* (i.e., the second color sub-pixel) after determines that the gray level of the red color sub-pixel 114*a* (i.e., the first color sub-pixel) is set within the predefined compensation range.

The timing controller 133 further determines whether the compensation value (e.g., the correction gray level of 6) for the green color sub-pixel 114*b* (i.e., the second color sub pixel) is greater than the predefined maximum correction gray level of the green color sub-pixel 114*b* (i.e., the second color sub pixel) based on the compensation value (e.g., correction gray level of 6) selected for the green color sub-pixel 114*b* (i.e., the second color sub pixel) acquired. When the timing controller 133 determines that the compensation value (e.g., correction gray level of 6) selected for the green color sub-pixel 114*b* (i.e., the second color sub pixel) is less than the predefined maximum correction gray level of the green color sub-pixel 114*b* (i.e., the second color sub pixel), the timing controller 133 computes the correction gray level for the green color sub-pixel 114*b* (i.e., the second color sub pixel) using the aforementioned interpolation equation, i.e., equation (2).

For instance, supposing the initial gray level of the green color sub-pixel 114*b* (i.e., the second color sub pixel) is 0 and the maximum correction gray level is 10. Then the correction gray level computed for the green color sub-pixel 114*b* (i.e., the second color sub pixel) is 6. Detail computation is shown in the equation (3).

$$\text{the correction gray level} = 0 + 6 \times \left(1 - \frac{0}{10}\right) = 6 \quad (3)$$

Accordingly, the timing controller 133 simultaneously transmits a digital gray level signal corresponding to the gray level of 6 for the red color sub-pixel 114*a* (i.e., the first color sub-pixel) and a digital correction gray level signal corresponding to the correction gray level of 6 for the green color sub-pixel 114*b* (i.e., the second color sub pixel) to the data driver circuit 132. The data driver circuit 132 subsequently operatively coordinates with the scan driver circuit 131 and generates the corresponding driving voltage driving the red color sub-pixel 114*a* and the green color sub-pixel 114*b* to display the display image.

For another instance, supposing the initial gray level of the green color sub-pixel 114*b* (i.e., the second color sub pixel) is 4 and the maximum correction gray level is 10. Then the correction gray level computed for the green color sub-pixel 114*b* (i.e., the second color sub pixel) is 7.6. Detail computation is shown in the equation (4).

$$\text{the correction gray level} = 4 + 6 \times \left(1 - \frac{4}{10}\right) = 4 + \frac{18}{5} \cong 7.6 \quad (4)$$

Accordingly, the timing controller 133 simultaneously transmits a digital gray level signal corresponding to the gray level of 6 for the red color sub-pixel 114*a* (i.e., the first color sub-pixel) and a digital correction gray level signal corresponding to one of the correction gray level of 7.6, 7 (floored), or 8 (rounded) of the green color sub-pixel 114*b* (i.e., the second color sub pixel) to the data driver circuit 132. The data driver circuit 132 subsequently operatively coordinates with the scan driver circuit 131 and generates the corresponding driving voltage driving the red color sub-pixel 114*a* and the green color sub-pixel 114*b* to display the display image.

When the timing controller 133 determines that the gray level of the red color sub-pixel 114*a* (i.e., the first color sub-pixel) is set within the compensation range while the correct gray level (i.e., the compensation value) for the green color sub-pixel 114*b* (i.e., the second color sub pixel) exceeds the maximum correction gray level, the timing controller 133 maintains the gray level of the green color sub-pixel 114*b* (i.e., the second color sub pixel) at the initial gray level. The timing controller 133 simultaneously transmits a digital gray level signal corresponding to the gray level of 6 for the red color sub-pixel 114*a* (i.e., the first color sub-pixel) and a digital correction gray level signal corresponding to the initial gray level of the green color sub-pixel 114*b* (i.e., the second color sub pixel) to the data driver circuit 132. The data driver circuit 132 subsequently operatively coordinates with the scan driver circuit 131 and generates the corresponding driving voltage driving the red color sub-pixel 114*a* and the green color sub-pixel 114*b* to display the display image.

Moreover, when the timing controller 133 determines that the gray level (e.g., gray level of 255) of the red color sub-pixel 114*a* (i.e., the first color sub-pixel) exceeds the compensation range, the timing controller 133 directly outputs the initial gray level of the green color sub-pixel 114*b* (i.e., the second color sub pixel) without apply any compensation. Even though the display panel 110 of the aforementioned embodiment uses 2-line inversion driving technique, however based on the above elaborations, those skilled in the art should be able to infer the implementation and/or operation for the driver unit 133 using three-line inversion or other driving techniques to drive the display panel 100, thus further descriptions are therefore omitted.

Figure 2:
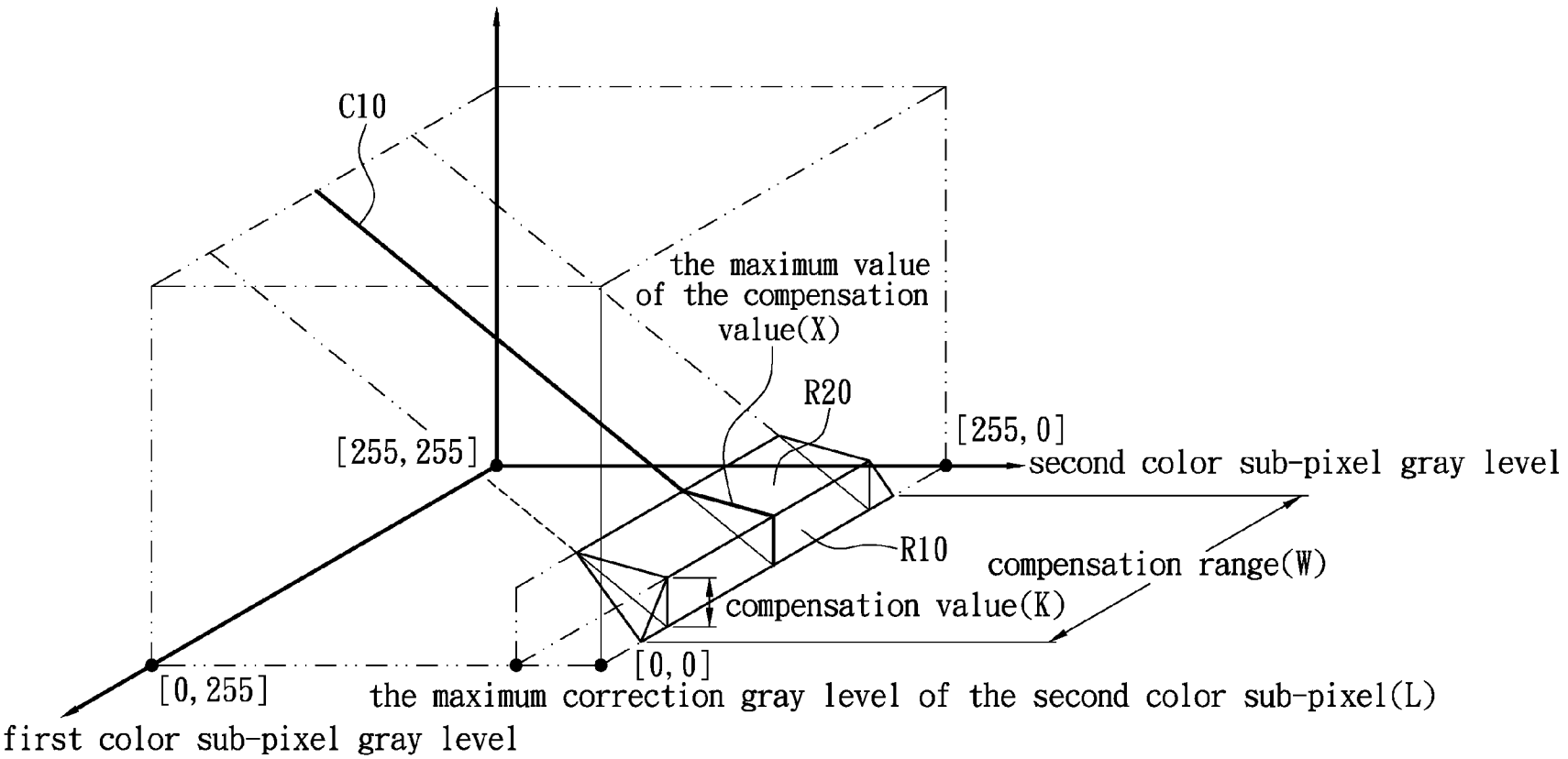
FIG. 2 is a diagram of a curve representing the gray level variation of the second color gray level provided in accordance to an exemplary embodiment of the present disclosure.

Please refer to FIG. 2, which shows a diagram of a curve representing the gray level variation of the second color gray level provided in accordance to an exemplary embodiment of the present disclosure. The curve C10 represents the gray level compensation curve of the second color sub-pixel corresponding to each gray level of the first color sub-pixel. Region R10 indicates the correction gray levels generated by compensating the initial gray levels of the second color sub-pixel at zero gray level. The compensating value for the initial gray level of the second color sub-pixel at zero gray level is K and the maximum value of the compensation sequence is X. When the initial gray level of the second color sub-pixel is less than or equal to the maximum correction gray level L thereof, the correction gray level of the second color sub-pixel gradually increases (i.e., forming an ascending compensation sequence). In particular, each correction gray level within region R20 are computed using the interpolation equation i.e., equation (2). Such that the gamma gray level curve of the second color sub-pixel appears to be smooth to avoid causing discrepancy in visual contrast. It is worth to note that as depicted by the curve C10, as the highest compensating value used for compensating the initial gray level of the second color sub-pixel at zero gray level is already the maximum value X, thus the correction gray level for compensating the initial gray level of the second color sub-pixel at nonzero gray level must be greater than the maximum value X and exhibit a gradually increase profile. That is the curve C10 must be a curve with positive slope to avoid inversion phenomenon occurred within the gray level range of the second color sub-pixel.

Additionally, it may be observed from region R10, within the compensation range W of the first color sub-pixel, the compensation values ascends from the maximum value X to the lower limit of the compensation range W and descends from the maximum value X to the upper limit of the compensation range W. Alternatively, as shown in FIG. 2, the compensation values for the second color sub-pixel between the lower limit of the compensation range W and the maximum value X increase as the gray level of the first color sub-pixel increases; the compensation values for the second color sub-pixel between the maximum value X and the upper limit of the compensation range W decrease as the gray level of the first color sub-pixel increases. Alternatively, region R10, which constitutes the correction gray levels generated by compensating the initial gray levels of the second color sub-pixel at zero gray level, is in a form of a trapezoidal region.

Figure 3:
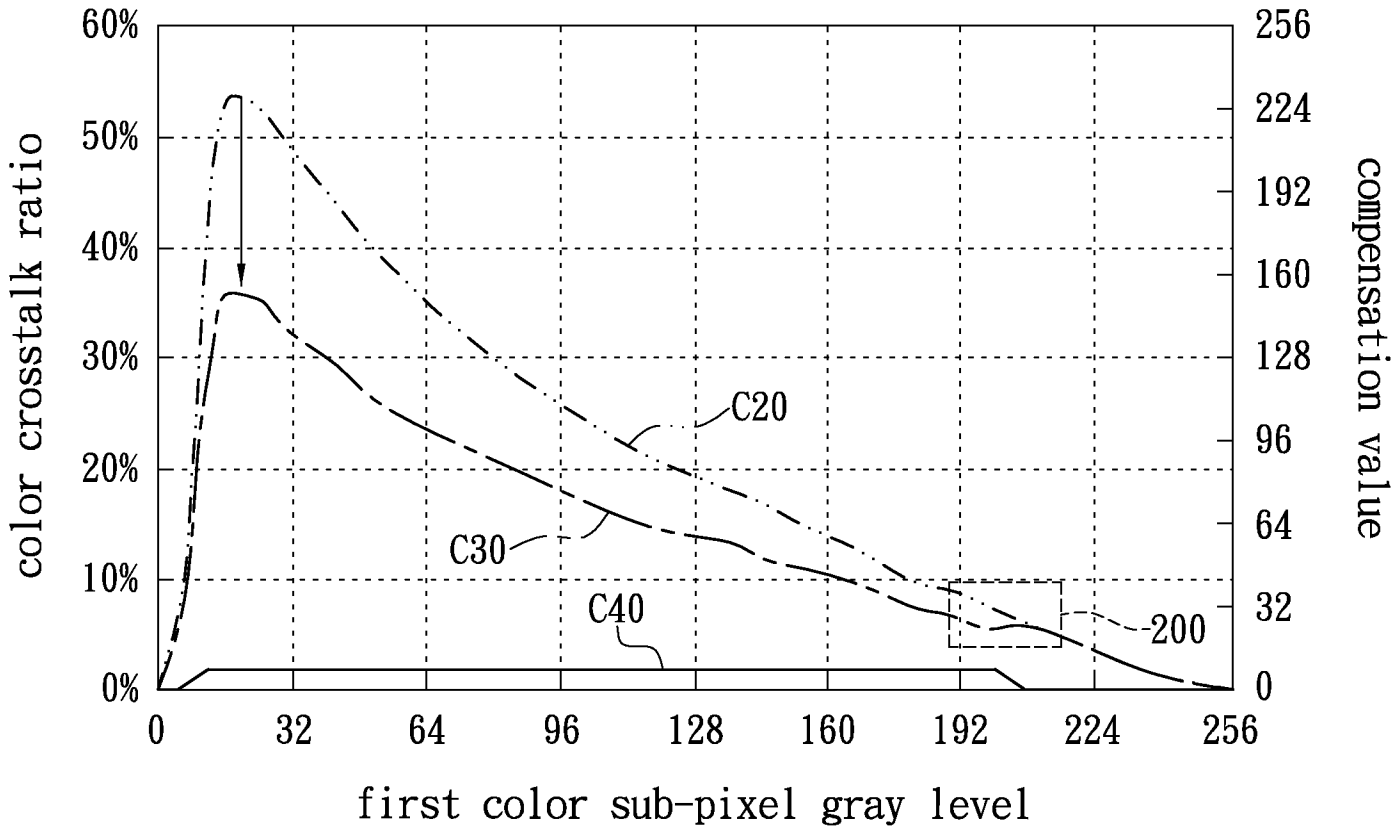
FIG. 3 is a diagram of a color crosstalk curve provided in accordance to an exemplary embodiment of the present disclosure.

Please refer to FIG. 3 in conjunction with FIG. 1, wherein FIG. 3 shows a diagram depicting a color crosstalk curve provided in accordance to an exemplary embodiment of the present disclosure. The color crosstalk curve is generated under the condition that the initial gray level of the second color sub-pixel is at zero gray level. The curve C20 represents the color crosstalk measured from the display panel 110 without compensation. The curve C30 represents the color crosstalk measured from the display panel 110 with compensation. The curve C40 corresponds the curve C30 representing the compensation curve of the compensation being applied to the second color cub-pixel at zero gray level.

As shown in FIG. 3, the color crosstalk (i.e., the curve C30) of the display panel 110 with compensation is relatively lowered, in particular in the region with low gray level. Accordingly, the compensation method may effectively reduce color crosstalk of the display panel 110, thereby enhance the display quality thereof. In addition, when the display panel 110 has been compensated, the color crosstalk (i.e., the curve C30) measured has a slope change indicated by an object 200. The color crosstalk of the display panel 110 measured in the gray level regions (e.g., gray level 0 to gray level 10 and gray level 200 to gray level 255) without compensation have the same slope as the curve C10 in the same region.

It shall be noted that table 1 is merely used to illustrate an implementation of the look-up table. FIG. 1 is merely serves to illustrate a circuitry implementation of the display panel 110. FIG. 2 is merely serves to graphically illustrate the gray level compensation array associated with the display apparatus. FIG. 3 merely shows comparison between the color crosstalk measured for a display panel before and after the pixel compensation under a specific compensation method. Accordingly, the table 1 and FIG. 1-3 should not be used to limit the scope of the present disclosure.

From the aforementioned exemplary embodiment, the present disclosure may generalize a crosstalk compensation method which can be adapted for a display panel illustrated in the aforementioned embodiment. The display panel includes a display panel, a backlight module, and a driver unit. The display panel may adopt the driving techniques such as N-line inversion, dot inversion or column inversion and the present disclosure is not limited thereto.

Figures 1, 4:
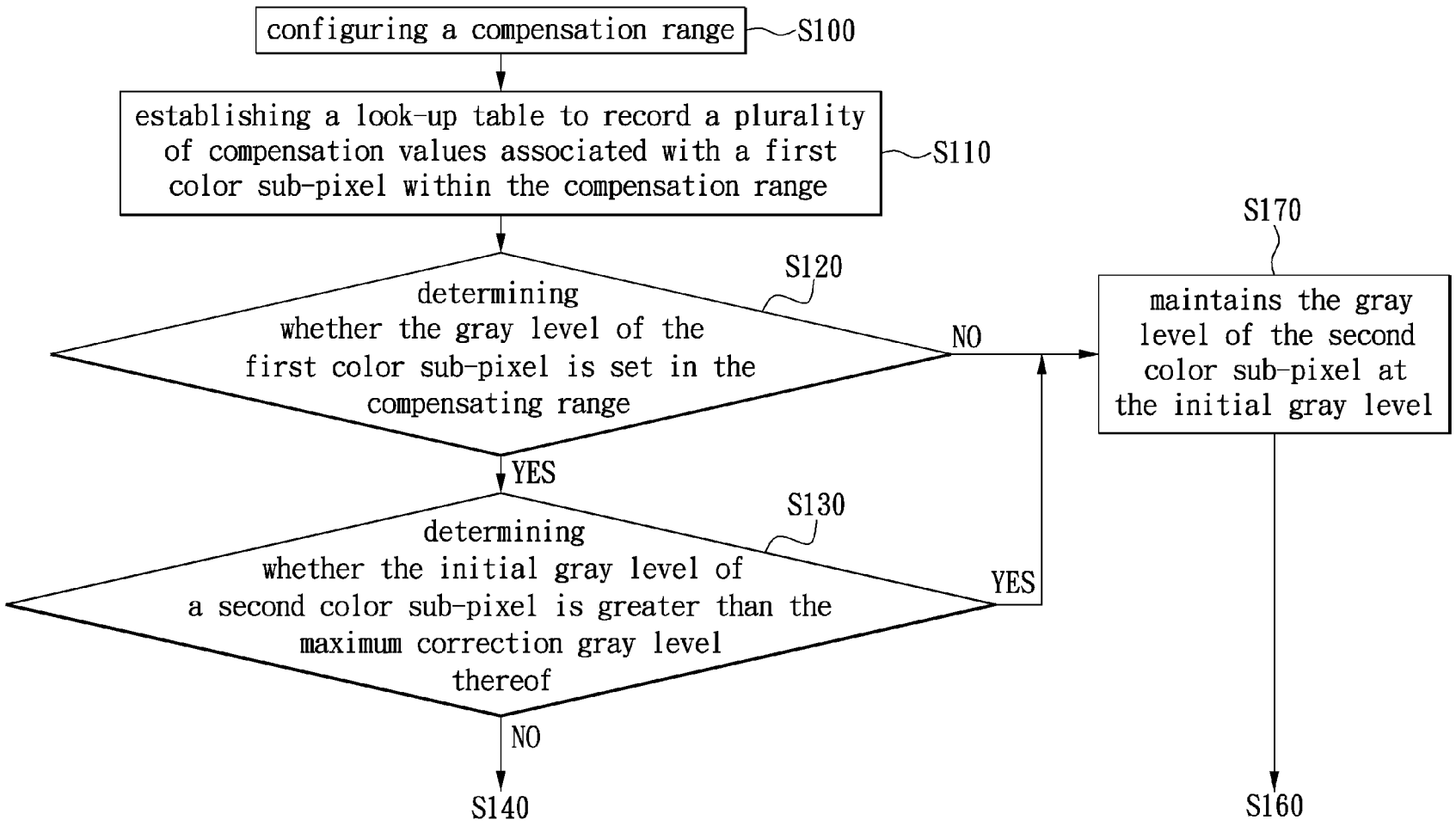
Figures 2, 4:
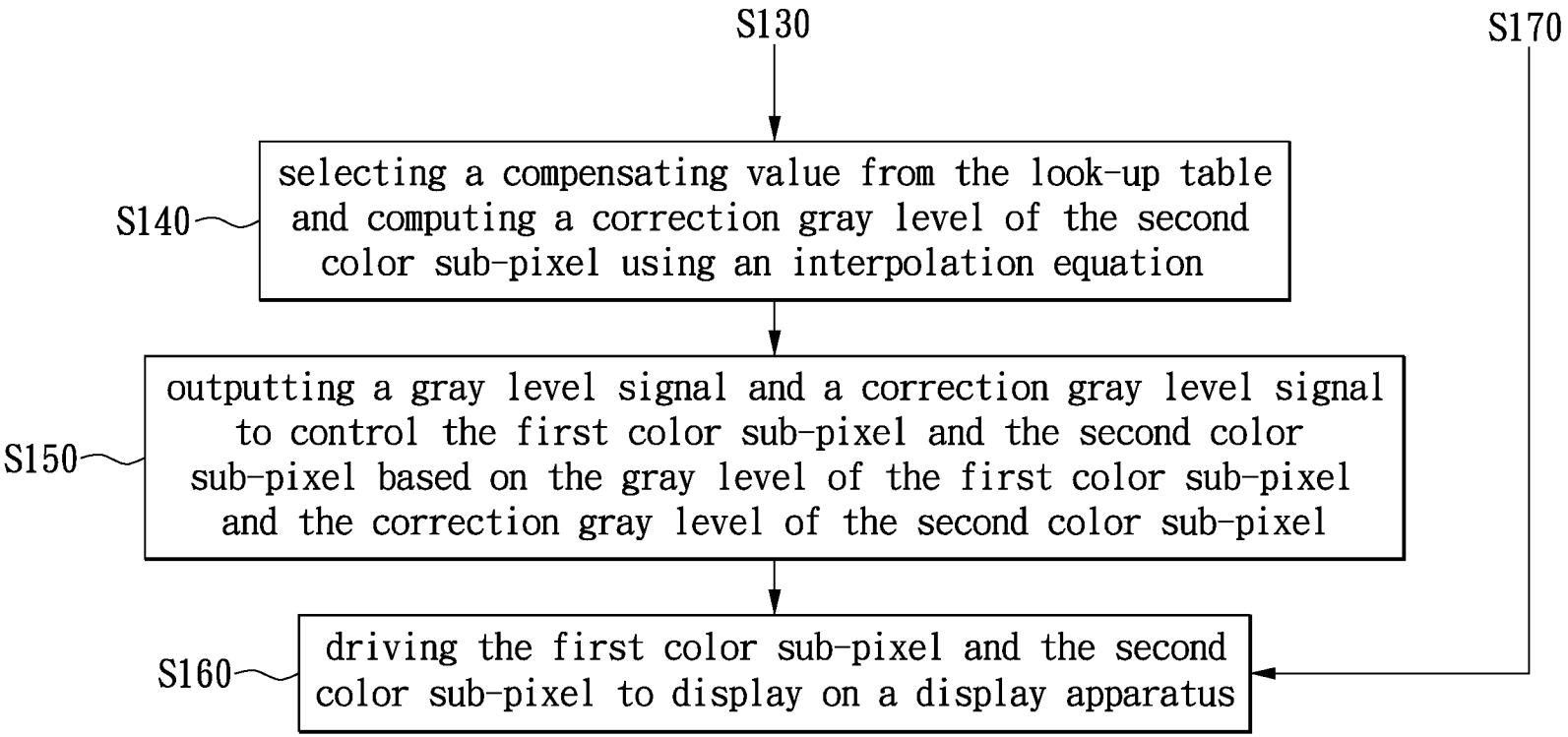

Please refer to FIG. 4-1 and FIG. 4-2 in conjunction with FIG. 1, wherein FIG. 4-1 and FIG. 4-2 respectively show a flowchart diagram illustrating a crosstalk compensation method of a display panel provided in accordance to an exemplary embodiment of the present disclosure. In Step S100, the designer of the display panel 110 may preconfigure a compensation range corresponding to a first color sub-pixel. The compensation range herein excludes the maximum gray level of the first color sub-pixel and the minimum gray level of the first color sub-pixel. The designer may configure the compensation range according to the color crosstalk measured on the display panel 110. In Step S110, a look-up table corresponding to the brightness compensation of the color sub-pixels (e.g., the red color sub-pixel R, the green color sub-pixel G, and the blue color sub-pixel B) on the display panel 110 is established and stored in the storage module 134 of the driver unit 130. The compensation look-up table may include the brightness values corresponding to gray level from 0 to i−1 and the corresponding compensating values of the adjacent color sub-pixel. i herein is an integer representing the total gray levels of a single color sub-pixel. When a single color sub-pixel has 8-bit resolution, i−1 equals to 255 gray levels; when a single color sub-pixel has 10-bit resolution, i−1 equals to 1023 gray levels and so on.

The storage module 134 in the instant embodiment may be implemented by a volatile memory chip or a non-volatile memory chip such as a flash memory chip, a read-only memory chip or a random access memory chip, however the present disclosure is not limited thereto.

In Step S120, the timing controller 133 determines whether the gray level of the first color sub-pixel is set in the compensating range according to an image data. When the timing controller determines that the gray level of the first color sub-pixel is set in the compensating range, executes Step S130; otherwise, executes Step S170.

In Step S130, the timing controller 133 determines whether the initial gray level of a second color sub-pixel is greater than the maximum correction gray level thereof according to the image data. When the timing controller 133 determines that the initial gray level of a second color sub-pixel is less than the maximum correction gray level, executes Step S140; otherwise, execute Step S170.

In Step S140, the timing controller 133 selects a compensating value from the look-up table and computes a correction gray level of the second color sub-pixel using an interpolation equation i.e., equation (2). In Step S150, the timing controller 133 outputs a gray level signal and a correction gray level signal to the data driver circuit 132 so as to control the first color sub-pixel and the second color sub-pixel based on the gray level of the first color sub-pixel and the correction gray level of the second color sub-pixel Subsequently, in Step S160, the data driver circuit operatively coordinates with the enable period of the scan driver circuit 131 and correspondingly generates the driving voltages to simultaneously drive the first color sub-pixel and the second color sub-pixel to display a display image on a display apparatus. Accordingly, the color crosstalk generated due to potential difference and coupling between the first color sub-pixel and the second color sub-pixel can be reduced. In Step S170, the timing controller 133 maintains the gray level of the second color sub-pixel at the initial gray level and executes Step S150.

In summary, exemplary embodiments of the present disclosure provides a crosstalk compensation method for a display panel and the display apparatus using the same, which can effective reduce or eliminate the crosstalk between a color sub-pixel and an adjacent color sub-pixel on the display panel by configuring the brightness of the adjacent color sub-pixel while driving the color sub-pixel to display a gray level. Accordingly, the potential difference between the electrodes of the neighboring sub-pixels and the brightness discrepancy may be reduced thereby enhanced the overall display quality.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A compensation method of a display panel, comprising:

selecting a compensating value from a look-up table for configuring an initial gray level to a correction gray level of a second color sub-pixel when the gray level of a first color sub-pixel is set within a compensation range; and maintaining the gray level of the second color sub-pixel at the initial gray level when the gray level of the first color sub-pixel is set outside the compensation range;

wherein the first color sub-pixel is adjacent to the second color sub-pixel;

wherein the step of configuring the gray level of the second color sub-pixel further comprises:

determining whether the initial gray level of the second color sub-pixel is greater than a maximum correction gray level thereof;

configuring the initial gray level as the correction gray level when it is determined that the initial gray level is greater than the maximum correction gray level of the second color sub-pixel; and calculating the correction gray level with the following equation when the initial gray level is less than the maximum correction gray level, $$\text{the correction gray level} = \text{the initial gray level} + \text{the compensation value} \times \left(1 - \frac{\text{the initial gray level}}{\text{the maximum correction gray level}}\right)$$

wherein the maximum correction gray level is greater than or equal to the maximum value of the compensation sequence in the compensation range while less than the maximum gray level of the second color sub-pixel.

2. The compensation method according to claim 1, wherein the second color sub-pixel has i gray levels and the compensation values within the compensation range forms an ascending compensation sequence with a maximum value thereof being less than or equal to i/128, wherein i is a positive integer.

3. The compensation method according to claim 2, wherein the compensation values increase from a lower limit of the compensation range to the maximum value of the compensation sequence and the compensation values decrease from the maximum value of the compensation sequence to an upper limit of the compensation range.

4. The compensation method according to claim 1, wherein the gray levels of the second color sub-pixel are arranged in an ascending order and the correction gray level is less than the maximum gray level of the second color sub-pixel.

5. A display apparatus, comprising:

a display panel, having a first color sub-pixel and an adjacent second color sub-pixel;

a driver unit, comprising a timing controller, a data driver circuit, and a storage module, the data driver circuit receiving gray level signals outputted by the timing controller, and converting the gray level signals into driving voltages so as to drive the first color sub-pixel and the second color sub-pixel of the display panel, wherein the driver unit is configured to execute the following steps:

driving the timing controller to select a compensating value from a look-up table for configuring an initial gray level of a second color sub-pixel to a correction gray level when the gray level of a first color sub-pixel set within a compensation range; and driving the timing controller to maintain the gray level of the second color sub-pixel at the initial gray level when the gray level of the first color sub-pixel is set outside the compensation range;

wherein the look-up table is stored in the storage module and records a plurality of compensation values corresponding to each gray level of the first color sub-pixel within the compensation range;

wherein the step of configuring the gray level of the second color sub-pixel further comprises:

determining whether the initial gray level of the second color sub-pixel is greater than a maximum correction gray level thereof;

configuring the initial gray level as the correction gray level when it is determined that the initial gray level is greater than the maximum correction gray level of the second color sub-pixel; and calculating the correction gray level with the following equation when the initial gray level is less than the maximum correction gray level, $$\text{the correction gray level} = \text{the initial gray level} + \text{the compensation value} \times \left(1 - \frac{\text{the initial gray level}}{\text{the maximum correction gray level}}\right)$$

wherein the maximum correction gray level is greater than or equal to the maximum value of the compensation sequence in the compensation range while less than the maximum gray level of the second color sub-pixel.

6. The display apparatus according to claim 5, wherein the second color sub-pixel has i gray levels and the compensation values within the compensation range forms an compensation sequence with a maximum value thereof being less than or equal to i/128, wherein i is a positive integer.

7. The display apparatus according to claim 6, wherein the compensation values increase from a lower limit of the compensation range to the maximum value of the compensation sequence and the compensation values decrease from the maximum value of the compensation sequence to an upper limit of the compensation range.

8. The display apparatus according to claim 5, wherein the gray levels of the second color sub-pixel are arranged in an ascending order and the correction gray level is less than the maximum gray level of the second color sub-pixel.

* * * * *